US006446295B1

(12) United States Patent
Calabrese

(10) Patent No.: US 6,446,295 B1
(45) Date of Patent: Sep. 10, 2002

(54) ELECTRIC TOOTHBRUSH

(75) Inventor: Giuseppe Calabrese, Gaggiano (IT)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/603,500

(22) Filed: Jun. 26, 2000

(30) Foreign Application Priority Data

Jul. 2, 1999 (EP) ..... 99202151

(51) Int. Cl.[7] ..... A46B 13/02
(52) U.S. Cl. ..... 15/28; 15/22.1
(58) Field of Search ..... 15/22.1, 110, 207.2, 15/28; 601/142

(56) References Cited

U.S. PATENT DOCUMENTS

| | | | | |
|---|---|---|---|---|
| 2,117,174 A | * | 5/1938 | Jones | |
| 3,195,537 A | * | 7/1965 | Blasi | |
| 3,509,874 A | * | 5/1970 | Stillman | |
| 3,563,233 A | * | 2/1971 | Bodine | |
| 4,277,862 A | * | 7/1981 | Weideman | |
| 4,827,551 A | * | 5/1989 | Maser | |
| 4,913,133 A | * | 4/1990 | Tichy | |
| 5,283,921 A | * | 2/1994 | Ng | |
| 5,497,526 A | | 3/1996 | Klinkhammer | |
| 5,604,951 A | | 2/1997 | Shipp | |
| 5,628,082 A | * | 5/1997 | Moskovich | 15/110 |
| 5,689,850 A | * | 11/1997 | Shekalim | 15/22.1 |
| 5,700,146 A | * | 12/1997 | Kucar | |
| 5,735,011 A | | 4/1998 | Asher | |

FOREIGN PATENT DOCUMENTS

| | | | |
|---|---|---|---|
| DE | 2 311 043 | * | 9/1974 |
| EP | 0 360 766 | | 3/1990 |
| EP | 0 435 329 | | 7/1991 |

OTHER PUBLICATIONS

European Search Report.
International Search Report.

* cited by examiner

*Primary Examiner*—Randall E. Chin
(74) *Attorney, Agent, or Firm*—Milton L. Honig

(57) ABSTRACT

An electric toothbrush comprises a handle and a head, characterised in that the head has a rubbery cleaning element.

1 Claim, 1 Drawing Sheet

ELECTRIC TOOTHBRUSH

BACKGROUND OF THE INVENTION

The present invention concerns an electric toothbrush comprising a handle and a head, characterised in that the head has a rubbery cleaning element.

1. Field of the Invention

Electric toothbrushes are well known in the art and typically comprise a motor element housed within the brush handle and a head, which is usually replaceable.

2. The Related Art

Electric toothbrushes are well known in the art and typically comprise a motor element housed within the brush handle and a head, which is usually replaceable.

There is a multitude of oscillating brushes on the market a and some have particular oscillating patterns, e.g. longitudinally oscillating elements, or they may have multiple brush heads, such as the one marketed by Phillips under the tradename 'Plaque Remover®', which comprises a rotating head and a laterally oscillating array of bristles distal to the brush handle.

An example of a vibrating brush is sold by J&J under the tradename 'Powerbrush®'.

Manual brushes with rubbery bristles are well-known in the prior art and may provide a polishing, cleaning or gum managing benefit. For example, WO 98/22000 (Asher) discloses a brush comprising at least one plaque removing member which is surrounded by a plurality of bristles. in our co-pending application GB 9912923.1 we describe a brush comprising a housing for a motor and a brush head which is flexible.

SUMMARY OF THE INVENTION

We have found that the benefits provided by a brush head comprising a rubbery cleaning element can be greatly enhanced if provided on an electric toothbrush.

An object of the present invention is to provide a cheap electric toothbrush, which provides an improved cleaning benefit.

BRIEF DESCRIPTION OF THE DRAWING

The invention will now be described with reference to the non-limiting figures in which.

DETAILED DESCRIPTION OF THE INVENTION

Accordingly, the present invention provides an electric toothbrush, characterised in that it comprises a rubbery cleaning element.

By rubbery cleaning element is meant a cleaning element, e.g. a bristle, which is made of a rubbery material ie. one which exhibits flexible and resilient characteristics.

In a preferred embodiment, the rubbery cleaning element is in the form of fingers which are generally thicker than conventional nylon bristles.

In a particularly preferred embodiment, the rubbery cleaning element is in the form of a flap or lamella. Such a flap or lamella may be either linear or arcuate in a cross-section parallel to the brush head base.

Depending on the size of the rubbery element it is envisaged that any number of rubbery elements may he present on the brush and may be in combination with any member of bristle tufts.

A rubbery cleaning element is an enlarged bristle made of a rubbery material. By rubbery is meant that the material has some elastic nature. Given that electric toothbrushes vibrate at an extremely high frequency it is anticipated that a high elastic nature is not necessary and a material with a Shore A hardness of less than 100 is suitable for use in the present invention.

In a preferred embodiment, the rubbery material has a Shore A hardness of less than 100, more preferably less than 80, and especially less than 55. Preferably the rubbery material also has a minimum Shore A hardness of 15, more preferably 25.

Particularly suitable rubbery material include elastomeric materials such as those described in WO97/20484, the contents of which are incorporated by reference.

It is also envisaged that the head of the crush according to the invention is replaceable.

The rubbery cleaning element may also serve to provide a polishing benefit to the teeth surfaces.

It is also possible for the rubbery cleaning element to additionally comprise abrasive materials such as silicas to enhance the cleaning or polishing benefit.

In an alternative aspect the invention provides an electric toothbrush with improved sensory benefits. The brush according to the invention provides an improved feel in the oral cavity, due to the presence of the rubbery material. This is particularly so when the non-bristle bearing surfaces of the head is significantly covered by a rubbery material and contacts the buccal lining. This sensory benefit is seen as an important consumer positive.

The head of the brush according to the invention may either be a vibrating head or an oscillating head. For example, the rubbery cleaning element may merely vibrate to effect cleaning or it may be fixed on a rotating head.

Figure 1:
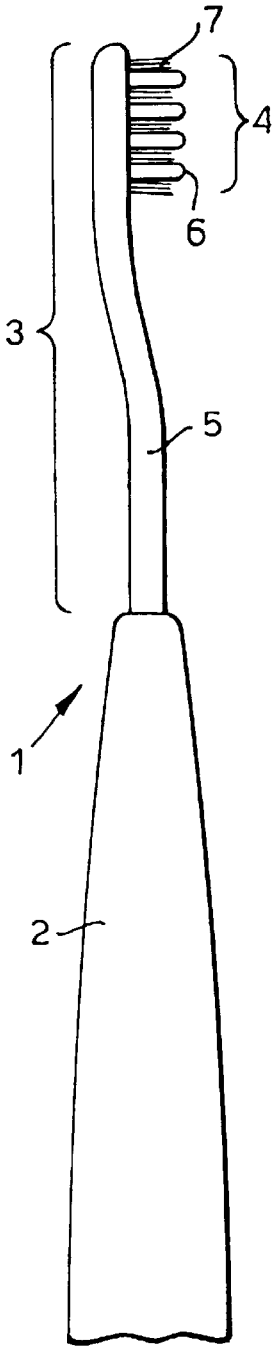
FIG. 1 is a side elevational view of an electric toothbrush according to the present invention.

FIG. 1 is an elevation of a brush according to the invention. It shows a brush (1) comprising a handle (2) and a head (3). The head (3) comprises a bristle bearing portion (4) and a neck portion (5). The bristle bearing portion (4) comprises a rubbery cleaning element (6) and conventional bristle tufts (7).

Typically, the handle (2, will comprise a motor element which vibrates or oscillates at least the brush head (3).

Figure 2:
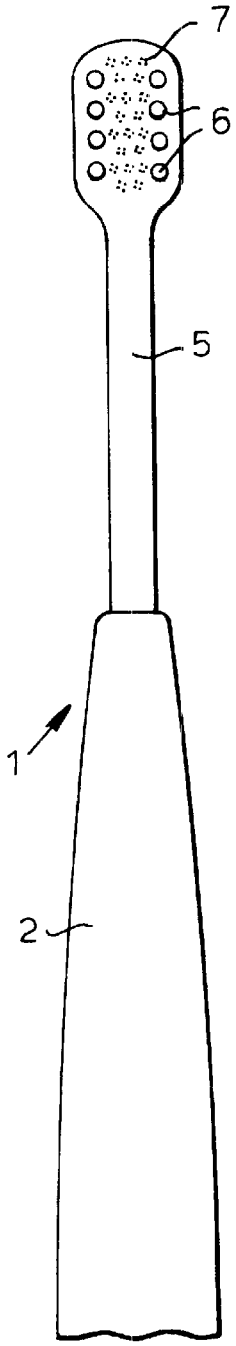
FIG. 2 is a front elevational view of the toothbrush according to FIG. 1.

FIG. 2 is a plan view of the brush shown in FIG. 1 showing the layout of the rubbery cleaning members and the conventional bristle tufts.

Figure 3:
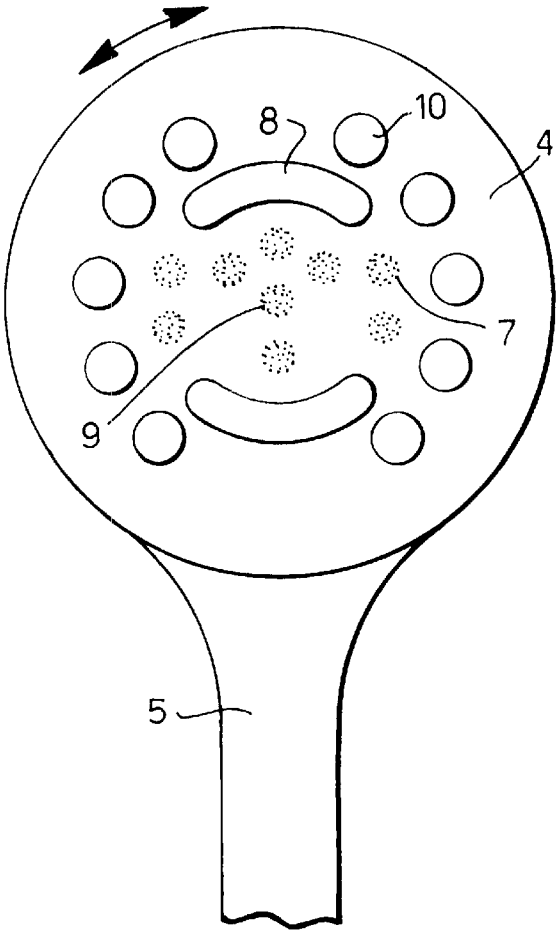
FIG. 3 is a partial view of a brush head for rotational movement.

FIG. 3 is a plan view of a brush head designed to rotate around a central point (9).

Shown are rubbery cleaning elements in the form of fingers (10) and lamellae (8) as well as conventional bristles (7).

What is claimed is:

1. An electric toothbrush comprising:

a housing in a form of a handle, the housing containing a motor; and a head attached to the handle and projecting from a round surface thereof an array consisting of two rubbery cleaning elements formed as a linear or arcuate lamella in cross-section parallel to a base of the head, a plurality of bristle tufts, the bristle tufts being positioned between the rubbery cleaning elements, the cleaning elements capable of being vibrated or oscillated by the motor.

* * * * *